US008020802B2

(12) United States Patent
Iacona

(10) Patent No.: US 8,020,802 B2
(45) Date of Patent: Sep. 20, 2011

(54) DISPENSER FOR FLEXIBLE CUTTING LINE

(75) Inventor: Fernando R. Iacona, Paradise Valley, AZ (US)

(73) Assignee: Kwik Products, Inc., Phoenix, AZ (US)

( * ) Notice: Subject to any disclaimer, the term of this patent is extended or adjusted under 35 U.S.C. 154(b) by 493 days.

(21) Appl. No.: 11/986,434

(22) Filed: Nov. 21, 2007

(65) Prior Publication Data

US 2008/0116218 A1 May 22, 2008

Related U.S. Application Data

(60) Provisional application No. 60/860,643, filed on Nov. 22, 2006.

(51) Int. Cl.
*B65H 49/18* (2006.01)

(52) U.S. Cl. ..... 242/588.6; 242/419.6; 242/580; 242/153

(58) Field of Classification Search ..... 242/562, 242/588, 588.3, 588.6, 396, 396.5, 419, 419.6, 242/579, 580, 153; 83/649, 650, 950; 206/303, 206/409

See application file for complete search history.

(56) References Cited

U.S. PATENT DOCUMENTS

| | | | | |
|---|---|---|---|---|
| 3,843,017 | A * | 10/1974 | Harrison | 221/63 |
| 4,652,331 | A * | 3/1987 | Plasencia | 156/526 |
| 5,826,817 | A * | 10/1998 | Selby | 242/588.6 |
| 2004/0149798 | A1 * | 8/2004 | Hoffman et al. | 225/46 |

* cited by examiner

*Primary Examiner* — William E Dondero
(74) *Attorney, Agent, or Firm* — Gerald E. Hespos; Michael J. Porco

(57) ABSTRACT

A dispenser for cutting line or string is provided. The dispenser for flexible cutting line includes a generally rectangular housing configured to accept a spool of cutting line, the housing being formed from two mateable side portions configured to snap together, wherein at least one portion of the housing is formed as a first opening to expose a view of an amount of cutting line on the spool; a donut portion disposed centrally in the housing configured for rotatably supporting the spool of cutting line in the housing; and at least one second opening formed in the housing configured for dispensing of the cutting line from the housing.

10 Claims, 5 Drawing Sheets

DISPENSER FOR FLEXIBLE CUTTING LINE

PRIORITY

This application claims priority to an application entitled "PACKAGE INCLUDING SPOOL AND SNAP-TYPE HOUSING FOR FLEXIBLE CUTTING LINE" filed in the United States Patent and Trademark Office on Nov. 22, 2006 and assigned Ser. No. 60/860,643, the contents of which are hereby incorporated by reference.

BACKGROUND OF THE INVENTION

1. Field of the Invention

This invention is directed to packaging for flexible cutting line which is used in garden string trimmers and, more particularly, to a dispenser or packaging which enables the user to easily and readily restring a garden string trimmer, and for readily storing the additional string for future use.

2. Description of the Prior Art

String trimmers are most often used to cut vegetation along a border of a flower bed or plot of grass which is adjacent to a sidewalk, driveway, or solid structure. The string trimmer rotates at a speed that makes the strings nearly imperceptible, and the operator of the string trimmer is not always able to see that the strings may come into contact with a hard surface and react accordingly. As a result, strings on a string trimmer are commonly broken. Examples of string trimmers are disclosed in applicant's U.S. Pat. Nos. 5,758,424 and 5,896,666, both of which are entitled "Head for String Trimmer" and the disclosures of which are incorporated herein by reference.

Conventional packaging for replacement string trimmers basically comprises a plastic blister pack, wherein a clam shell type plastic housing includes what is known in the industry as a donut, about which a long length of string is wound, usually on the order of 300 feet. The prior art clam shell packaging includes an opening for dispensing the string. However, because of the string being wound around the donut-shaped recess within the clam shell packaging, it is often difficult to dispense the string from the packaging, thereby resulting in frustration on behalf of the user.

As a result of the foregoing deficiency in the prior art packaging for strings used in string trimmers, there is a need for new and improved packaging for readily dispensing and loading string within a new and improved package to facilitate loading and dispensing of the string or cutting line.

SUMMARY OF THE INVENTION

An object of the subject invention is to provide a new and improved packaging for storing and dispensing string or cutting line and, more particularly, a new and improved packaging which results in the customer being able to easily dispense the string.

These and other objects of the invention are achieved by applicant's combination dispenser or packaging which includes a separate spool which is accommodated within a snap-type packaging having a donut, with the spool interengaging the donut so as to be rotatable thereon, thereby facilitating the easy dispensing of the string from the subject package.

In addition to the above features, the packaging includes an open corner which enables the user to observe the condition and amount of string remaining on the spool. The string is wound about the spool prior to the spool being inserted into the snap-type packaging and over the donut. At such time the spool is rotatable about the donut, thereby facilitating the dispensing of the string from the subject package.

Furthermore, the packaging is provided with an elongated restricted slot for controlling the rate at which the string is pulled out of the packaging during a dispensing operation.

According to one aspect of ht subject invention, a dispenser for flexible cutting line is provided including a housing; a donut portion disposed centrally in the housing configured for rotatably supporting a spool of cutting line in the housing; and at least one opening formed in the housing configured for dispensing of the cutting line from the housing. The at least one portion of the housing is formed as an opening to expose a view of an amount of cutting line on the spool. In another aspect, the housing is formed from two mateable side portions configured to snap together, wherein each side portion includes at least one projection configured to interengage with a corresponding at least one projection on an opposite side portion.

In a further aspect, the at least one opening is configured as at least two unaligned openings for restricting the dispensing of the cutting line from the housing.

In another aspect, the dispenser furthering includes a cutting device disposed adjacent to the at least one opening for dispensing of the cutting line. In one aspect, the cutting device is a blade disposed in the housing. In yet another aspect, the cutting device is a spring-loaded plunger including a cutting blade disposed on the plunger.

According to another aspect of the subject invention, the donut portion includes a fixed member connected to the housing and a rotatable member coupled to the fixed member wherein the rotatable member rotates in one direction to prevent the cutting line from retracting into the housing.

According to a further aspect, a dispenser for flexible cutting line includes a generally rectangular housing configured to accept a spool of cutting line, the housing being formed from two mateable side portions configured to snap together, wherein at least one portion of the housing is formed as a first opening to expose a view of an amount of cutting line on the spool; a donut portion disposed centrally in the housing configured for rotatably supporting the spool of cutting line in the housing; and at least one second opening formed in the housing configured for dispensing of the cutting line from the housing, wherein the at least one second opening is configured as at least two unaligned openings for restricting the dispensing of the cutting line from the housing.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION OF THE PREFERRED EMBODIMENT

Figure 1:
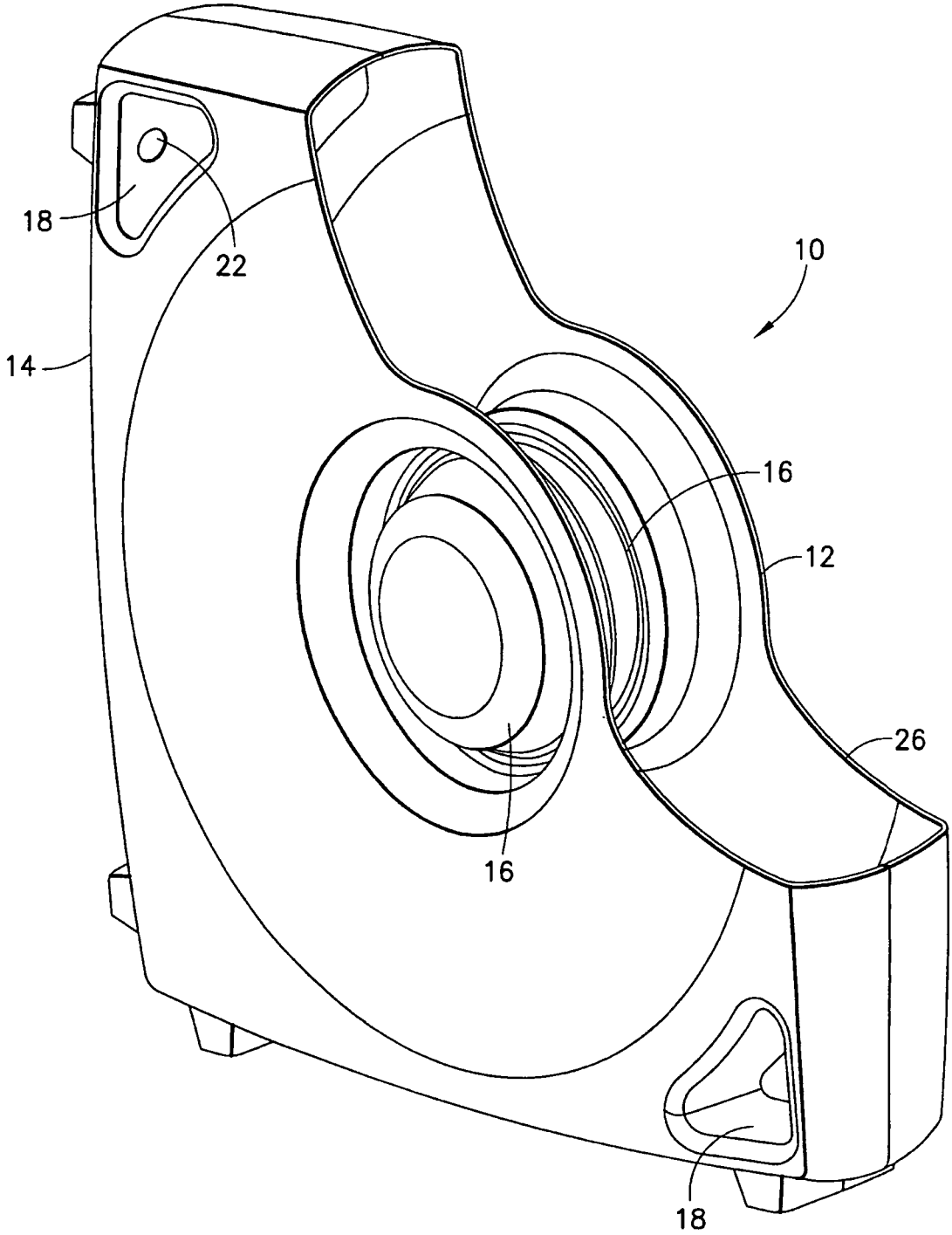
FIG. 1 is a perspective view of the plastic package housing of the subject invention.
Figure 2B:
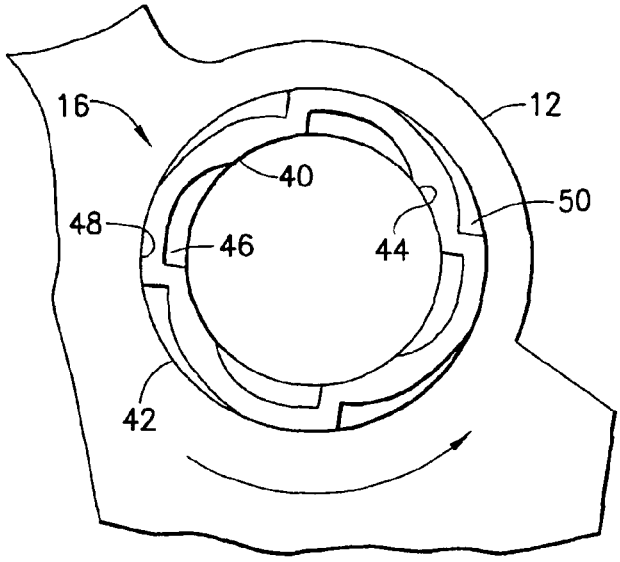
FIG. 2*b* is a partial view of a donut portion for supporting a spool of string or cutting lime in accordance with an embodiment of the subject invention.
Figure 2A:
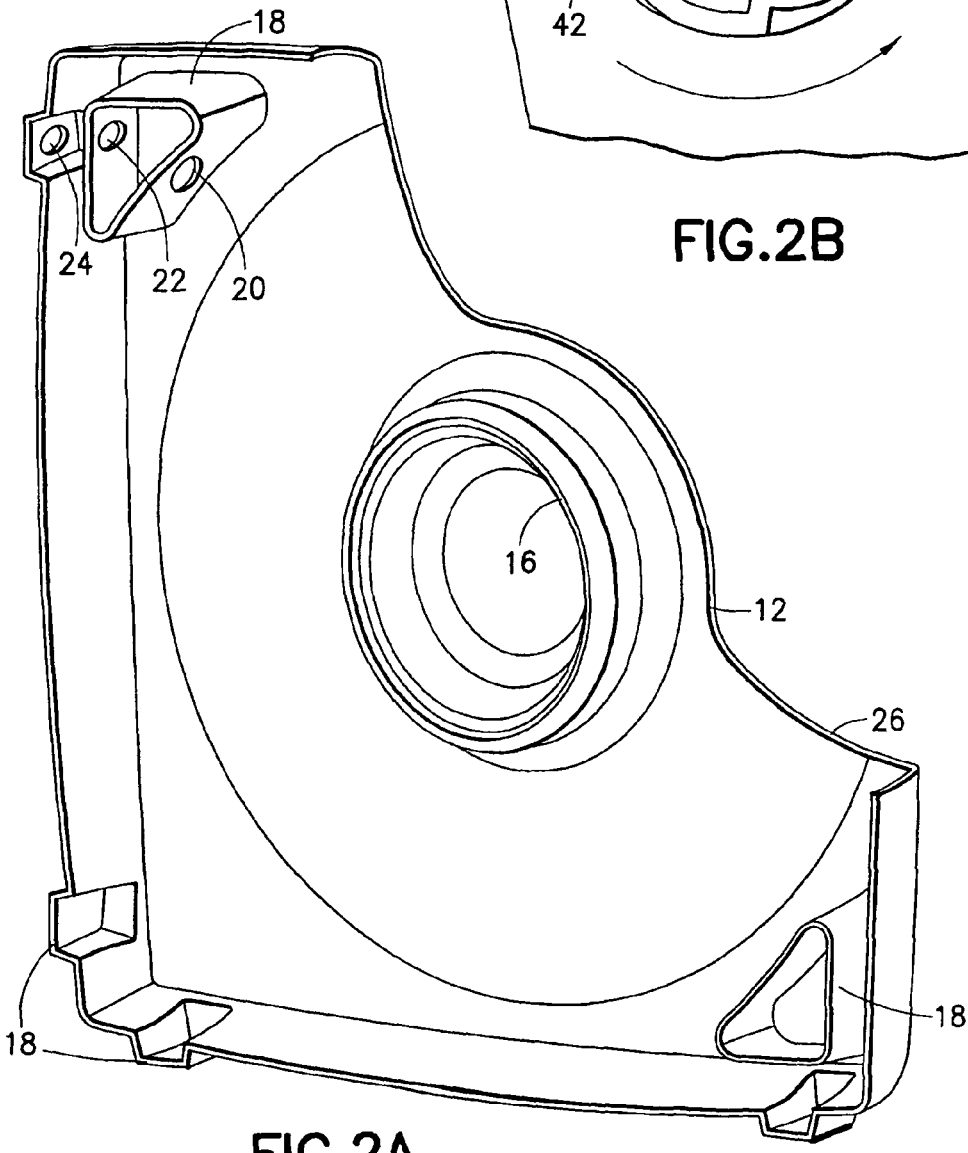
FIG. 2A is a perspective view of one-half of the packaging of the subject invention, with the other half being substantially a mirror image thereof.

Turning to FIGS. 1 and 2, a dispenser for cutting line or string is provided including a generally rectangular housing configured to accept a spool of string or cutting line. The plastic packaging or housing of the subject invention is generally designated by the numeral 10 and includes two interengaging side portions 12 and 14. As illustrated in FIG. 2A, each side portion includes a central donut portion 16, as well as projections 18 which are adapted to be interengaged in order to form the snap-type packaging as illustrated in FIG. 1. Along one corner of the packaging 10 are aligned openings 20, 22 and 24 which are provided for restricting the dispensing of the string from the packaging 10.

As shown in FIGS. 1 and 2A, one corner of the snap-type packaging 10 is open by means of a tapered side opening 26 which enables the user to view the spool and the amount of string on the spool. Usually, the packaging 10 is made of plastic and is opaque, such as being colored black, thereby necessitating the opening 26 for viewing the spool. It is to be appreciated that a variety of known plastics may be utilized to form the package or housing of the present disclosure including but not limited to Polyethylene (PE), Polypropylene (PP), Polystyrene (PS), High impact polystyrene (HIPS), Acrylonitrile butadiene styrene (ABS), Polyethylene terephthalate (PET), Poly(vinyl chloride) (PVC); Polyurethanes (PU) and Polycarbonate (PC).

Figure 3:
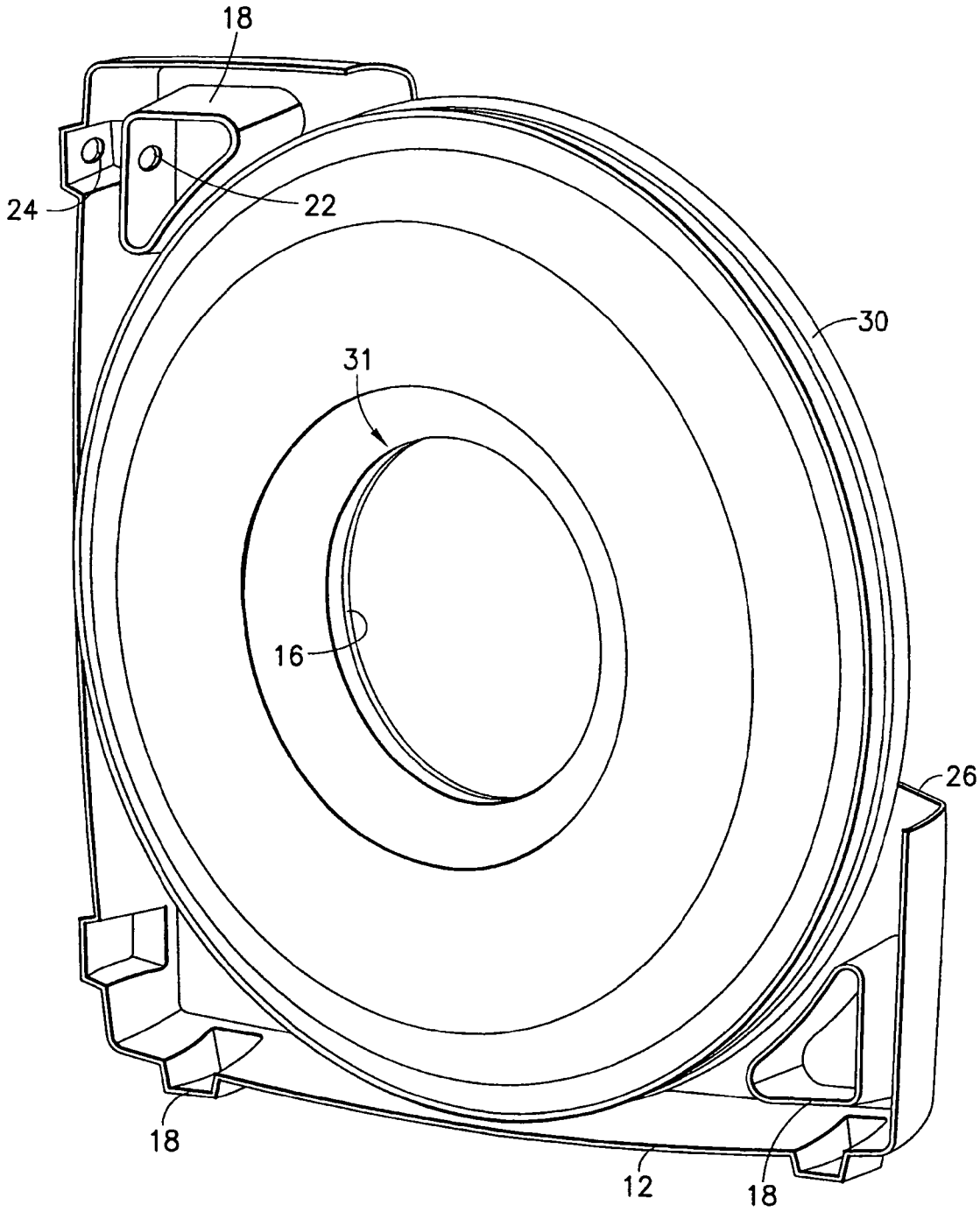
FIG. 3 illustrates a spool mounted within one-half of the packaging of the subject invention.

As shown in FIG. 3, a spool 30 has been mounted on the donut portion 16 of one side 12 of the packaging 10. The spool 30 includes a central opening 31 for engaging the central donut portion 16 of the sides 12 and 14, thereby enabling the spool 30 to be rotated about the central donut within the snap-type packaging 10.

Figure 4:
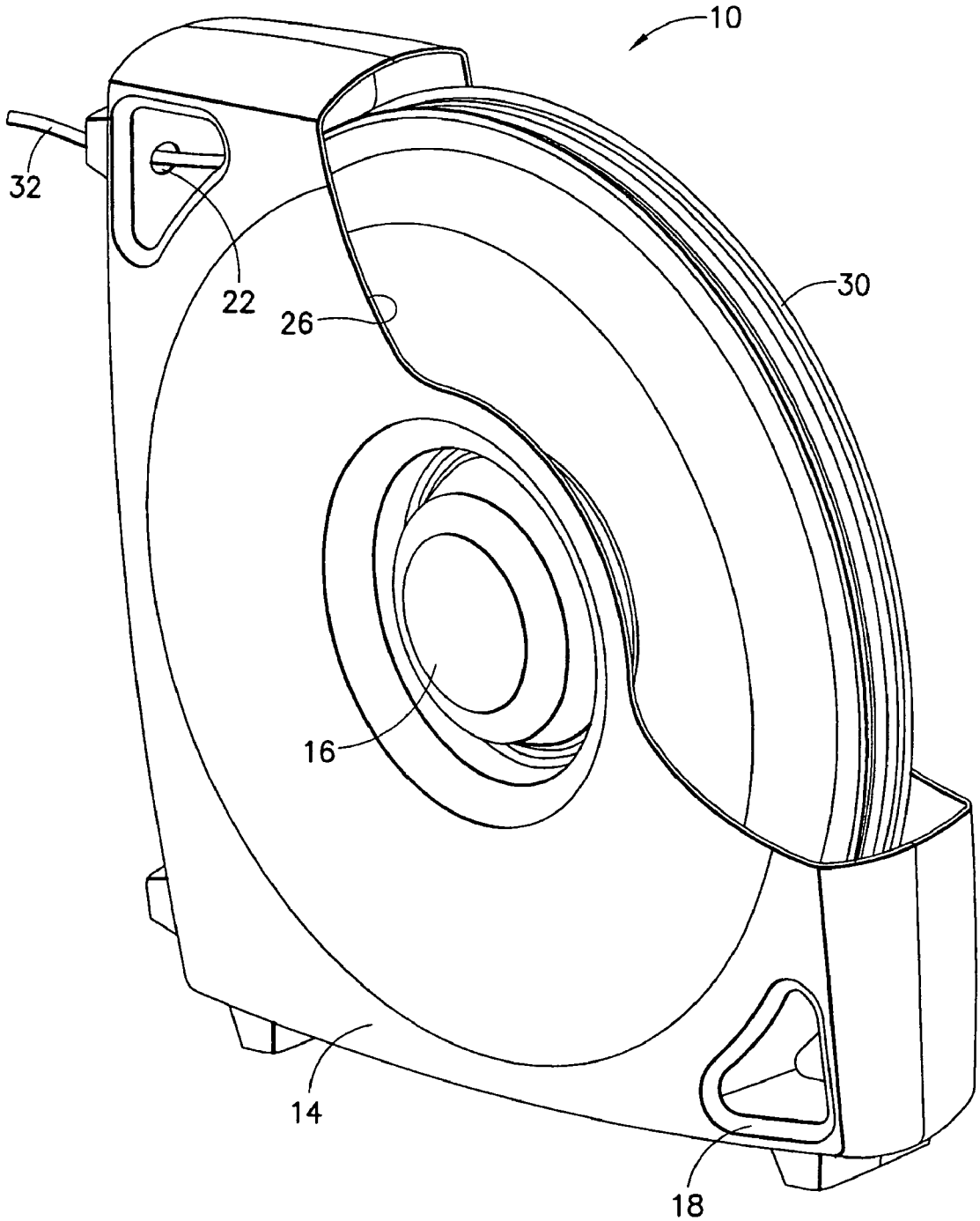
FIG. 4 is the assembly of a spool within the subject package, including the end of the string extending out of the snap-type packaging of the subject invention.

Turning to FIG. 4, in the final assembly of the spool 30 within the packaging or housing 10, the end of the string 32 is shown extending through the openings 20, 22 and 24 and enables the user to pull out string as required. In one embodiment, the openings 20, 22, and 24 are unaligned or slightly off-centered from each other so as to contact the string or cutting line. In this manner, the openings 20, 22 and 24 will retain the string or cutting line and prevent the string or cutting line from retracting into the housing.

In a further embodiment, the donut portion 16 may be configured to allow the spool to rotate in only one direction thereby preventing the string or cutting line from retracting into the housing. Referring to FIG. 2B, the donut portion 16 includes a fixed member 40 connected to at least one side portion 12 the housing 10 and a rotatable member 42 coupled to or disposed over the fixed member 40. An outer surface 44 of the fixed member 40 includes a plurality of teeth or saw-like projections 46 and an inner surface 48 of the rotatable member 42 includes corresponding teeth or saw-like projections 50, wherein the rotatable member 42 is only able to rotate in one direction as illustrated by the arrow in FIG. 2B. In use, the spool 30 is disposed in the housing 10 wherein the central portion 31 of the spool 30 is mated with the rotatable member 42 allowing the spool to rotate in only one direction thereby preventing the string 32 from retracting into the housing 10.

After the user has pulled out the length of string that is needed, the user merely cuts the string and it effectively locks the remaining string within the package.

Figure 5:
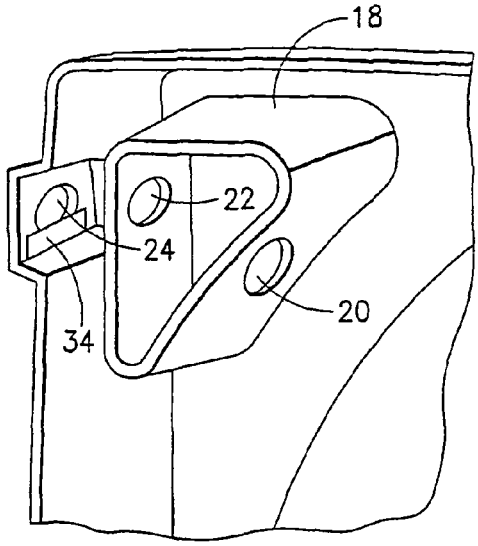
FIG. 5 is a partial view of the packaging or housing illustrating a cutting device in accordance with an embodiment of the subject invention.

In a further embodiment, the dispenser of the present disclosure may include a cutting device for cutting the string or cutting line after a desired length is withdrawn from the housing 10, obviating the need to carry a separate cutting device by the user. Referring to FIG. 5, a cutting device 34 configured as a blade is disposed adjacent to opening 24. When the housing 10 is assembled, the cutting device 34 will be hidden from and not be accessible to the user. After a desired length of string or cutting line is withdrawn, the user will pull the string downward in relation to the housing causing the string 32 to come into contact with the cutting device 34 and separate the string from the spool.

Figure 6A:
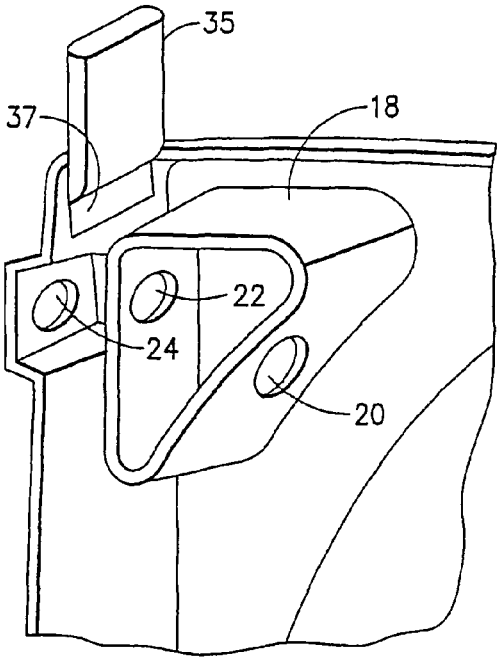
FIGS. 6A and B are partial views illustrating another embodiment of the cutting device.
Figure 6B:
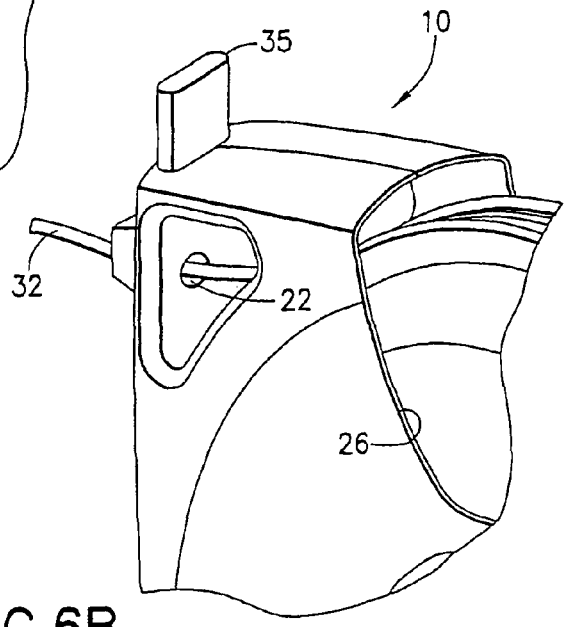

In another embodiment, the cutting device is configured as a spring-loaded plunger as shown in FIGS. 6A and 6B. Referring to FIG. 6A, a plunger 35 is disposed in an opening in the housing 10. The plunger 35 includes a cutting blade 37 positioned above a pathway of the string 32 when loaded into the housing 10. The plunger is spring-loaded so upon actuation in a downward manner to cut the string the plunger will return to its original state allowing a new length of string to be passed through opening 24. It is to be appreciated the spring-loading of the plunger can be configured in a variety of ways. FIG. 6B shows the plunger 35 emanating from the housing 10. When assembled, the cutting blade 37 of the plunger 35 is completely within the housing preventing possible injury to the user.

The combination of a separate spool 30 along with the snap-type package 10 of the subject invention affords the user with a unique dispensing structure, as well as a structure which readily stores the string for future use.

Although the invention has been described in connection with monofilament string line as used in a garden string trimmer, it is applicable to any type of monofilament string, such as fishing line.

While the disclosure has been shown and described with reference to certain preferred embodiments thereof, it will be understood by those skilled in the art that various changes in form and detail may be made therein without departing from the spirit and scope of the disclosure.

What is claimed is:

1. A dispenser for flexible cutting line comprising:

a generally rectangular housing configured to accept a spool of cutting line, the housing being formed from two mateable side portions configured to snap together, wherein at least one portion of the housing is formed as a first opening to expose a view of an amount of cutting line on the spool;

a donut portion disposed centrally in the housing configured for rotatably supporting the spool of cutting line in the housing; and at least one second opening formed in the housing configured for dispensing of the cutting line from the housing, wherein a projection is disposed within the housing adjacent to the at least one second opening including at least two openings configured to allow the cutting line to extend through each of said at least two openings, with the longitudinal axes of said at least two openings being off-centered so as to contact the cutting line for restricting the dispensing of the cutting line from the housing.

2. The dispenser as in claim 1, wherein each side portion includes at least one projection configured to interengage with a corresponding at least one projection on an opposite side portion.

3. The dispenser as in claim 1, furthering comprising a cutting device disposed adjacent to the at least one opening for dispensing of the cutting line.

4. The dispenser as in claim 3, wherein the cutting device is a blade.

5. The dispenser as in claim 3, wherein the cutting device is a spring-loaded plunger including a cutting blade disposed on the plunger.

6. The dispenser as in claim 3, wherein the cutting device is disposed inside the housing.

7. The dispenser as in claim 1, wherein the donut portion includes a fixed member connected to the housing and a rotatable member coupled to the fixed member wherein the rotatable member rotates in one direction to prevent the cutting line from retracting into the housing.

8. The dispenser as in claim 1, wherein the donut portion includes a fixed member connected to the housing and a rotatable member coupled to the fixed member configured for rotatably supporting the spool of cutting line, an outer surface of the fixed member includes a plurality of saw-like projections and an inner surface of the rotatable member includes corresponding saw-like projections wherein the rotatable member rotates in one direction for dispensing the cutting line and is prevented from rotating in the opposite direction by the saw-like projections to prevent the cutting line from retracting into the housing.

9. The dispenser as in claim 1, furthering comprising a cutting device disposed in the housing between the at least one seconding opening and the projection for cutting the cutting line after a desired length is withdrawn from the housing.

10. A dispenser for flexible cutting line comprising:

a generally rectangular housing configured to accept a spool of cutting line, the housing being formed from two mateable side portions configured to snap together, wherein at least one portion of the housing is formed as a first opening to expose a view of an amount of cutting line on the spool;

a donut portion disposed centrally in the housing configured for rotatably supporting the spool of cutting line in the housing, the donut portion includes a fixed member connected to the housing and a rotatable member coupled to the fixed member configured for rotatably supporting the spool of cutting line, an outer surface of the fixed member includes a plurality of saw-like projections and an inner surface of the rotatable member includes corresponding saw-like projections wherein the rotatable member rotates in one direction for dispensing the cutting line and is prevented from rotating in the opposite direction by the saw-like projections to prevent the cutting line from retracting into the housing;

at least one second opening formed in the housing configured for dispensing of the cutting line from the housing, wherein a projection is disposed within the housing adjacent to the at least one second opening including at least two openings configured to allow the cutting line to extend through each of said at least two openings, with the longitudinal axes of said at least two openings being off-centered so as to contact the cutting line for restricting the dispensing of the cutting line from the housing; and a cutting device disposed in the housing between the at least one seconding opening and the projection for cutting the cutting line after a desired length is withdrawn from the housing.

* * * * *